United States Patent [19]

Marston et al.

[11] 4,066,991

[45] Jan. 3, 1978

[54] PRESSURE SUPPORT FOR LIMITING STRAIN IN A SUPERCONDUCTING WINDING

[75] Inventors: Peter G. Marston, Gloucester; John J. Nolan, Cambridge, both of Mass.

[73] Assignee: Sala Magnetics, Inc., Cambridge, Mass.

[21] Appl. No.: 633,975

[22] Filed: Nov. 20, 1975

[51] Int. Cl.² ..... H01F 7/22

[52] U.S. Cl. ..... 335/216; 335/300; 174/15 CA

[58] Field of Search ..... 335/216, 300; 174/126 S, 128 S, 15 CA, 15 S

[56] References Cited

U.S. PATENT DOCUMENTS

| | | | |
|---|---|---|---|
| 3,736,365 | 5/1973 | Bobo et al. | 174/15 S |
| 3,947,622 | 3/1976 | Graneau | 174/15 S |
| 3,986,341 | 10/1976 | DeHaan | 174/15 S |

*Primary Examiner*—George Harris

*Attorney, Agent, or Firm*—Joseph S. Iandiorio

[57] ABSTRACT

A pressure support unit for limiting strain in a superconducting winding including a restraining member surrounding the superconducting winding; and a pressure compartment, having at least one segment for receiving pressurized fluid, disposed between the superconducting winding and the restraining member; and a pressure support system comprising a plurality of such pressure support units.

13 Claims, 9 Drawing Figures

PRESSURE SUPPORT FOR LIMITING STRAIN IN A SUPERCONDUCTING WINDING

FIELD OF INVENTION

This invention relates to a pressure support device for limiting strain in superconducting windings.

BACKGROUND OF INVENTION

Superconducting windings are typically formed of materials which are highly sensitive to strain such as vanadium-gallium alloys and niobium-tin alloys. In smaller superconducting magnets with lower fields the effect of strain may not be as important as in large magnets of high fields. However, the use of large, powerful, superconducting magnets is contemplated such as for example in rotating machines such as cryogenic electric generators, plasma physics, fusion devices, magnetic separators, and solid state and high energy physics. There are proposed superconducting magnets cylindrical in form with a diameter of a few meters and a length of many hundreds of meters. Large superconducting magnets are also proposed in the form of toroidal circular and "D" windings. Toroidal shapes having a major radius of approximately 20 meters and minor cross-sectional diameter of approximately 10 meters are also proposed. In such magnets the strain induced in their generally circular windings by the radial force component, or "magnetic pressure," due to the magnetic field may cause interruptions in the current flow of the windings and disrupt the field, even though that strain is well within the strain limits of the surrounding mechanical support structure. This and related problems impair the development of many contemplated superconducting magnet applications and have increased the cost of other applications and have possibly caused still other magnets to fail to meet their anticipated magnetic field levels. To prevent such problems the stress in the mechanical support structure must be limited to a level far below its capability in order to keep the strain in the windings to a level that can be tolerated by the windings without interfering with their performance.

SUMMARY OF INVENTION

It is therefore an object of this invention to provide an improved, simple, more reliable, and inexpensive pressure support device which substantially reduces the strain induced in the superconducting windings for a given magnetic field strength.

It is a further object of this invention to provide such a device which permits a stress in the mechanical support structure far in excess of that corresponding to the resultant strain that can be tolerated by the windings.

The invention results from the realization that an improved pressure support device for a superconducting magnet can be achieved by using a pressurized fluid medium between the magnet windings and the mechanical support structure to counterbalance the magnetic pressure produced by the magnetic field and to communicate a major portion of the stress and the resultant strain to the mechanical support member while minimizing the strain induced in the superconducting windings.

The invention features a pressure support unit for limiting strain in superconducting windings. The unit includes a mechanical structure, a restraining member, surrounding the superconducting windings and a pressure compartment, having at least one segment for receiving pressurized fluid, disposed between the superconducting windings and the restraining member.

In a preferred embodiment a pressure support system is used which includes a plurality of such units. Each pressure compartment includes one or more segments separated either circumferentially about the windings or longitudinally to it, or both. In a preferred embodiment each of the units surrounded by another unit includes a second pressure compartment disposed between its restraining member and the associated windings of the other, surrounding, unit.

DISCLOSURE OF PREFERRED EMBODIMENT

Other objects, features and advantages will occur from the following description of a preferred embodiment and the accompanying drawings, in which.

Figure 1:
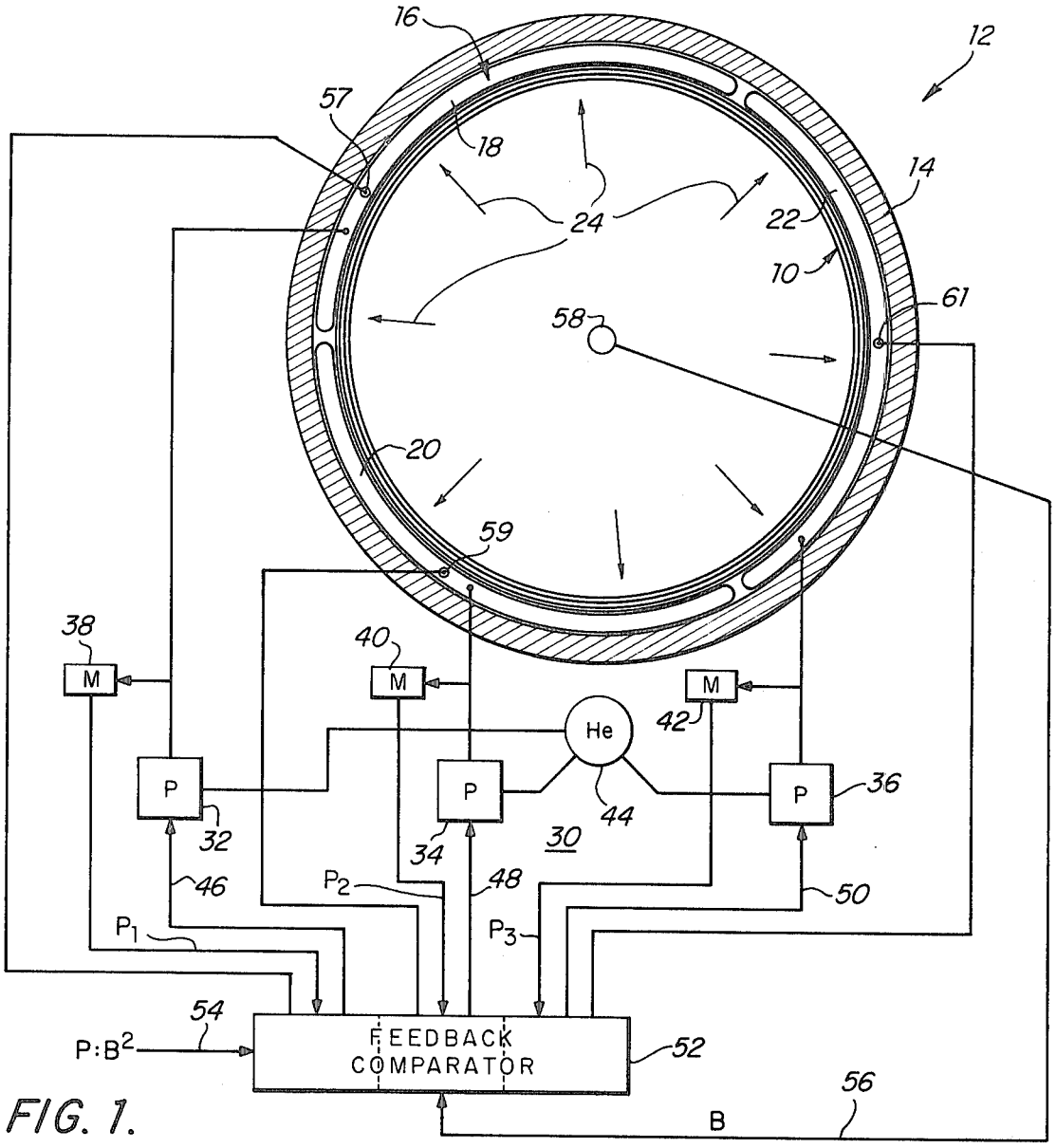
FIG. 1 is a simplified, cross-sectional, schematic diagram of a superconducting coil, an associated pressure support unit, and a pressure control circuit according to this invention.

There is shown in FIG. 1 a superconducting winding or coil 10 surrounded by a pressure support unit 12, including a restraining cylinder 14, typically made of stainless steel and a pressure compartment in the form of bag 16 including three segments 18, 20 and 22. Segments 18, 20 and 22 of bag 16 are made of welded stainless steel sheets approximately 1/10 inch thick. The magnetic field direction is generally perpendicular to the paper. The radially, outwardly directed force or magnetic pressure, arrows 24, stresses the coil 10 and restraining cylinder 14 and induces a strain in them which because of their generally circular form is regarded as "hoop" strain: one which is virtually entirely tensile in nature.

As the magnetic field intensity increases so too does the magnetic pressure and stress in the restraining cylinder 14 and coil 10 which might be made of vanadium-gallium alloys or niobium-tin alloys. In the absence of pressure bag segments 18, 20 and 22, coil 10 would be restrained only by restraining cylinder 14; thus the force generated by the magnetic field and the magnetic field intensity would have to be limited so that the stress on the restraining cylinder 14 would be no greater than that which would produce an excessive strain in coil 10.

However, with pressure bag segments 18, 20 and 22 installed as shown stresses may be tolerated in the restraining cylinder 14 which are far in excess of the stresses which would produce intolerable strain in coil 10. This is accomplished by pressurizing bag segments 18, 20 and 22 with a fluid, such as helium, until the pressure therein is sufficient to limit the strain in coil 10 to within tolerable limits and yet communicate that stress, far in excess of one which would produce the strain within those limits, to restraining cylinder 14.

With a magnetic field of 5.774 tesla (57.74 kG) generating a magnetic pressure of $13.26 \times 10^6 N/m^2 = 1924$ psi, a gas pressure of 1924 pounds per square inch of helium in bag segments 18, 20 and 22 would be used to permit a stress on restraining cylinder 14 of approximately 150,000 pounds per square inch while maintaining a strain of $5 \times 10^{-3}$ in restraining cylinder 14 and yet a strain in coil 10 of virtually zero.

Although in FIG. 1, the pressure bag 16 is shown as having three segments 18, 20 and 22, this is not a necessary limitation of the invention. Bag 16 may contain more or fewer circumferentially oriented segments. For example, it may contain one, two, twenty or a hundred segments depending upon how fine a control is desired for positioning of coil 10. When a bag having only one segment is used, it is difficult to properly control the position of coil 10 if the forces are such that coil 10 is biased toward one point or another on its circumference. Coil 10 must be supported against gravity forces, and various magnetic interactions. These interactions include magnetic forces between magnet coils and ferromagnetic objects in the vicinity, either necessarily or accidentally placed near the coils. With two or more segments one or more may be pressurized higher while others are pressurized lower to control the positioning of coil 10 within restraining cylinder 14.

Pressurizing circuit 30, FIG. 1, includes a pump 32, 34, 36, a pressure sensing device 38, 40 and 42, and a position sensing device 57, 59, 61 associated with each segment 18, 20 and 22, respectively. Each of pumps 32, 34 and 36 is connected to a helium reservoir 44 and is controlled by electrical signals received on lines 46, 48 and 50, respectively, from feedback comparator 52. For a very long magnet (length many times the diameter) the variation of the pressure P required in the pressure bag for a given field intensity B to minimize the strain in coil 10 may be calculated as follows: $P = B^2/2\mu_o$ where $\mu_o$ is the permeability of free space $0.4 \times 10^{-6}$ hen/m. In general $P:B^2$ reference information may be stored in comparator 52 or delivered to feedback comparator 52 on line 54. Feedback comparator 52 then compares the signal on line 56 representing field intensity B sensed by magnetic sensor 58, which may be a Hall device, with signals representing the gas pressures $P_1$, $P_2$, $P_3$ from pressure sensing devices, meters 38, 40 and 42, respectively. Any deviation from the proportion required by the reference information delivered on line 54 causes the related pump to increase or decrease the pressure in the associated segment and keep the strain within the desired limits. Signals from position sensors 57, 59, 61 are used in a similar fashion to centrally position coil 10 within reasonable limits with respect to restraining cylinder 14. In operation signals from the position sensors control minor differences in $P_1$, $P_2$, $P_3$. Alternately in FIG. 1 reservoir 44 could represent a common high pressure helium source and items 32, 34, 36 would then be control valves rather than pumps.

Figure 2:
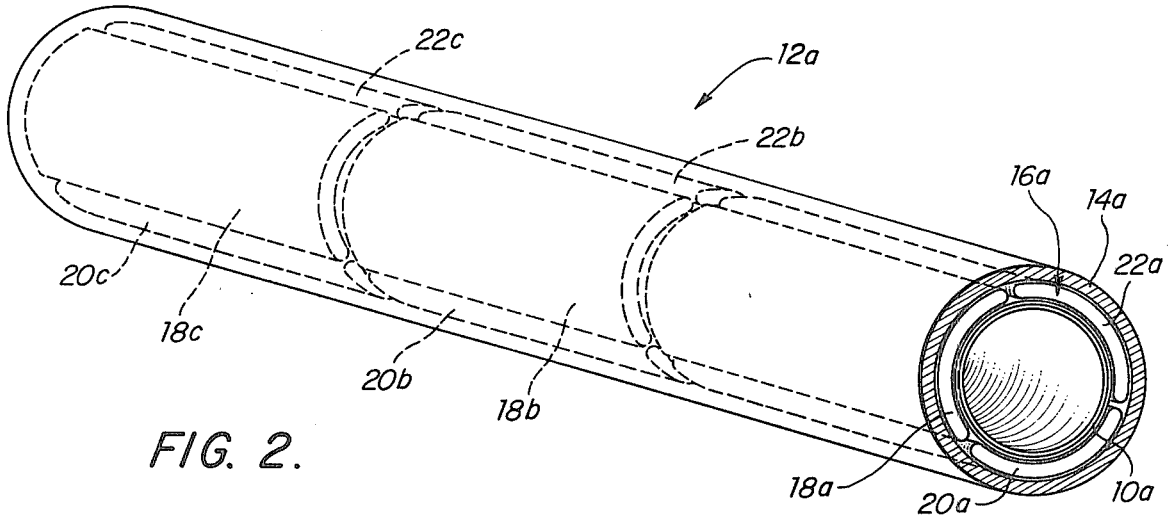
FIG. 2 is an axonometric view of a long, cylindrical superconducting magnet structure using a pressure support unit, as shown in FIG. 1.

As indicated with respect to FIG. 1 the cross-section of pressure support unit 12 shown in FIG. 1 may be that of a long narrow cylinder 12*a* as shown in FIG. 2, where like parts have been given like numbers and similar parts similar numbers accompanied by a lower case *a*. In FIG. 2, pressure bag 16*a* includes, in addition to the three circumferential segments 18*a*, 20*a* and 22*a*, longitudinal segments 18*b*, 18*c*; 20*b*, 20*c*; and 22*b*, 22*c*.

Figure 3:
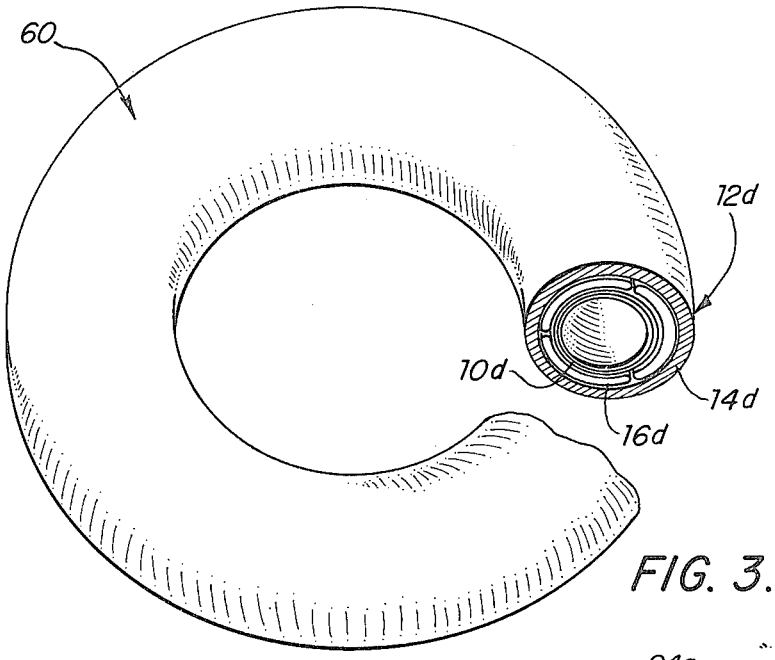
FIG. 3 is a circular toroidal magnet structure using a pressure support unit, as shown in FIG. 1.
Figure 3A:
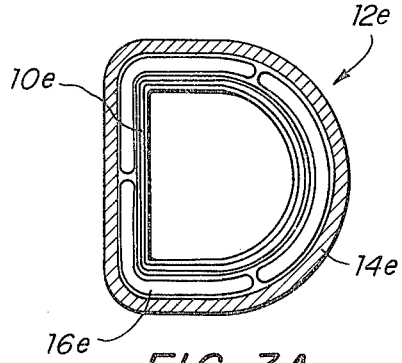
FIG. 3A is a cross-sectional view of a "D" type toroidal coil.

Pressure support unit 12, FIG. 1, may also represent the cross-section of a toroidal coil 60, FIG. 3, where like parts have been given like numbers accompanied by a lower case *d*. In some cases, toroidal coils are designed with a "D" shaped cross-section, as shown in FIG. 3A, where like parts have been given like numbers accompanied by a lower case *e* with respect to FIG. 1. This is done to cause the conductors, if unsupported, ideally to be purely in tension. With toroidal systems the circumferential segmentation is more important than with straight solenoid systems. With toroidal systems different segments operate at substantially different pressures whereas with the straight systems the different segments operate at essentially the same pressure: only minor differences are required for position control.

Figure 4:
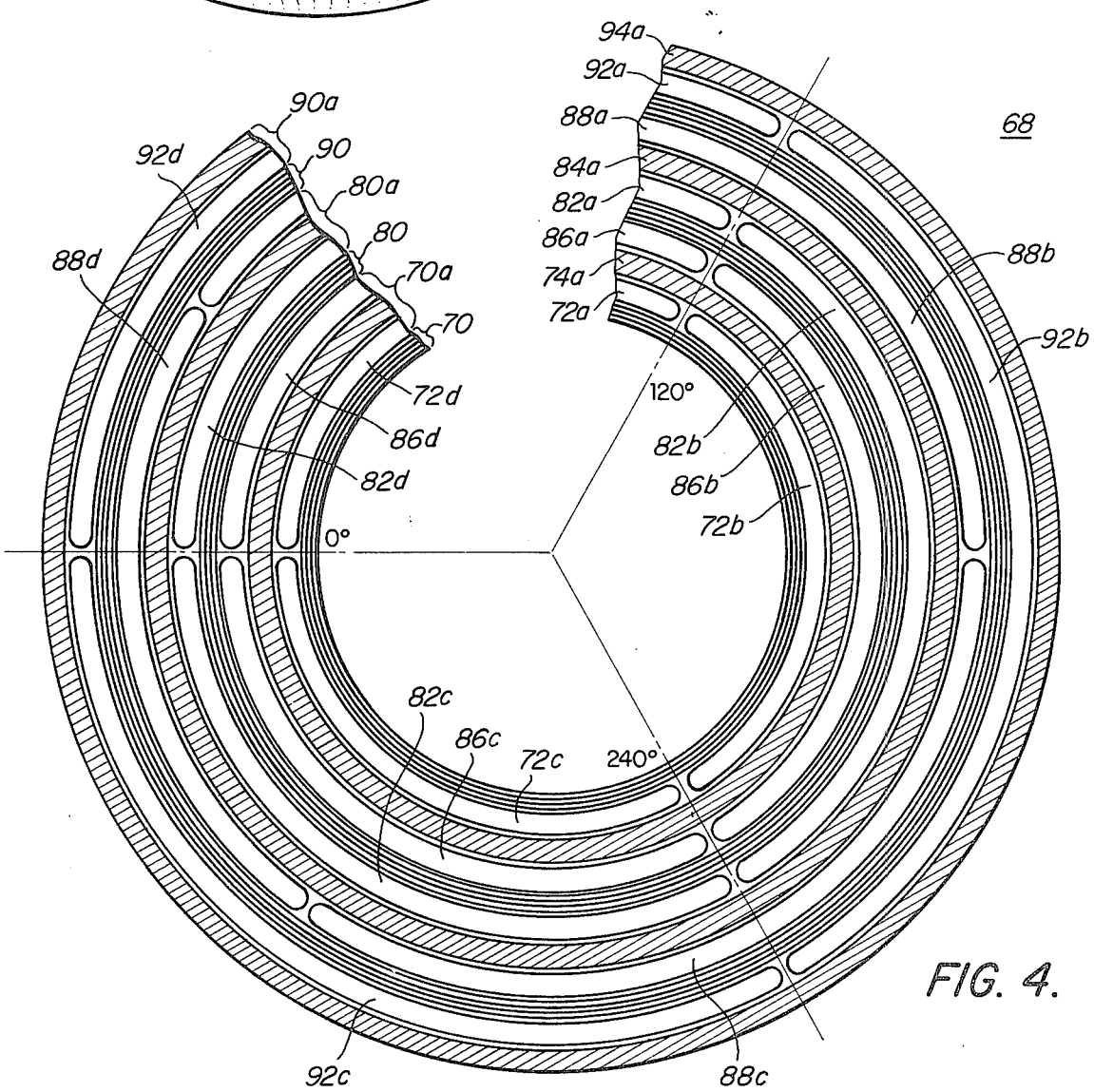
FIG. 4 is a simplified, sectional, schematic diagram of a plurality of pressure support units arranged in a pressure support system having a plurality of superconducting coils according to this invention.

Although thus far the invention has been illustrated with but one coil and one associated pressure support unit, this is not a necessary limitation of the invention. Often two or more coils are arranged concentrically and with a similar number of pressure support units to form a pressure support system as shown in FIG. 4 which shows three concentric coils 70, 80 and 90. Associated with each of these coils is a pressure support unit 70*a*, 80*a*, 90*a*, each of which includes a pressure bag and and a restraining cylinder 72*a*, 74*a*; 82*a*, 84*a*; and 92*a*, all respectively. Each pressure support unit which is surrounded by another outer pressure support unit, namely pressure unit 70*a* which is surrounded by pressure unit 80*a*, and pressure unit 80*a* which is surrounded by pressure unit 90*a* may include a second pressure bag 86*a*, 88*a*, respectively, disposed between the associated restraining cylinder and the coil of the surrounding pressure support unit. Thus the additional pressure bag 86*a* in unit 70*a* is between restraining cylinder 74*a* and coil 80 while the additional pressure bag 88*a* in unit 80*a* is disposed between restraining cylinder 94*a* and coil 90. The use of these additional pressure bags enables the adjacent outer restraining cylinder to enlarge as the strain is induced in it without this expansion producing a further strain in the externally adjacent winding.

Although, as illustrated, each of the pressure bags 72*a*, 82*a*, 92*a*, 86*a* and 88*a* are shown having three segments, indicated in FIG. 4 by the same reference numeral as the bag accompanied by a lower case *b*, *c* and *d*, this is not a necessary limitation of the invention as indicated above in the discussion with reference to FIGS. 1 and 2. In addition, although in FIG. 4 the segments of the bags extend for approximately 120° to 0° this is not a necessary limitation of the invention. Each bag may have a different number of segments; each of the segments within each bag may extend for the same arcuate segment or different arcuate segments; and the terminus between the segments may be aligned from unit to unit or may be staggered as shown for example by the offsetting of the segments 88*b*, *c* and *d* of pressure bag 88*a*.

Figure 5:
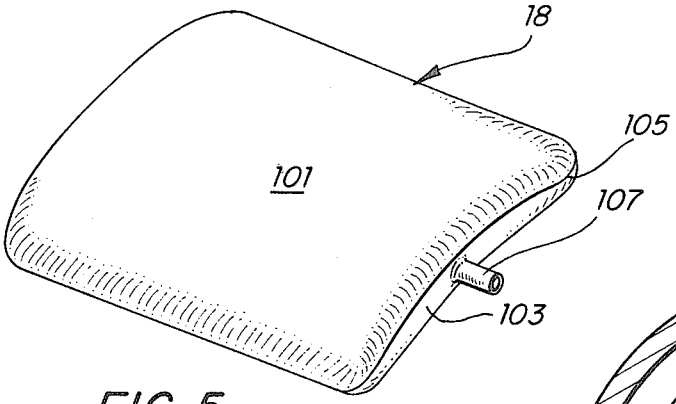
FIG. 5 is a simplified, axonometric diagram of a bag segment according to this invention.

Each pressure bag or segment thereof may be constructed, as exemplified by segment 18, FIG. 5, which is formed of two 0.1 inch thick stainless steel sheets 101, 103 welded at seam 105 and provided with a pressurizer connection 107.

Figure 6:
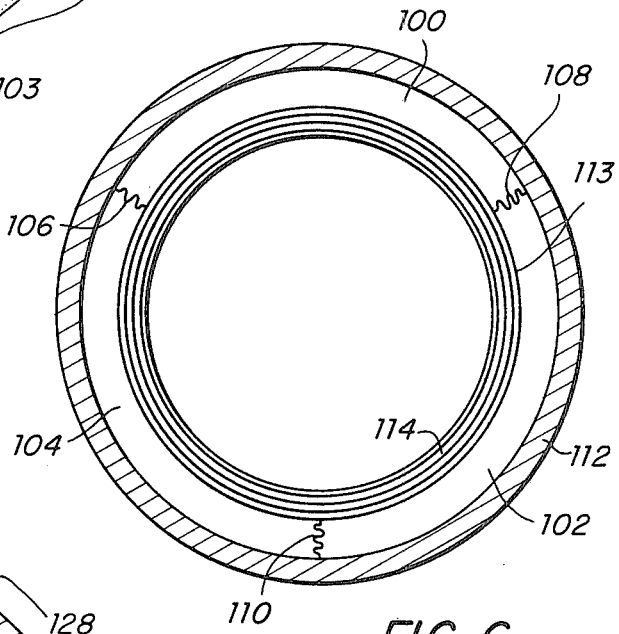
FIG. 6 is a diagram similar to FIG. 1 showing an alternative compartment structure.

Alternatively, the pressure compartments 100, 102, 104 shown much enlarged, FIG. 6, may be formed using common bellows elements 106, 108, and 110 interconnected between restraining member, cylinder 112 and the sealed outer area 113 of the superconducting coil 114. If additional segments are desired such as illustrated in FIG. 2, additional bellows elements may be used to achieve that segmentation too.

Figure 7:
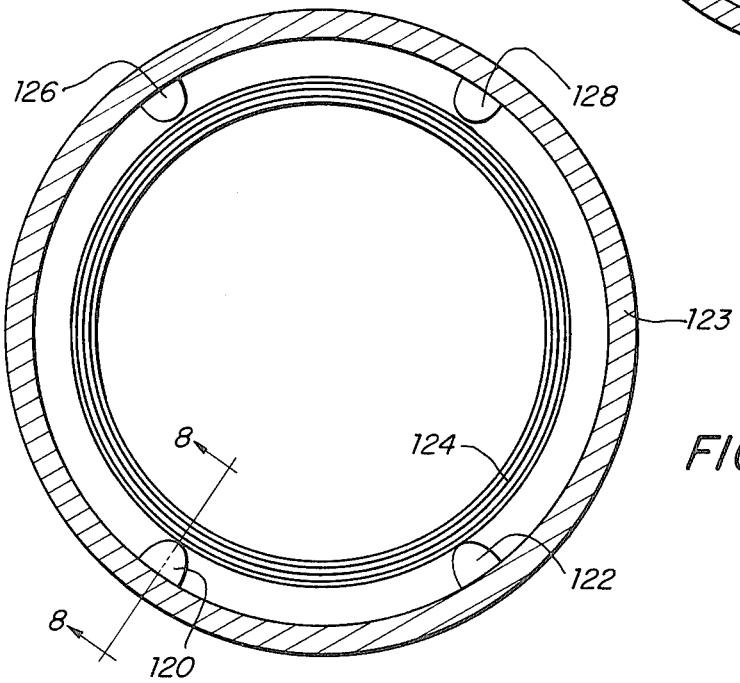
FIG. 7 is a diagram similar to FIG. 1 showing auxiliary mechanical support members.
Figure 8:
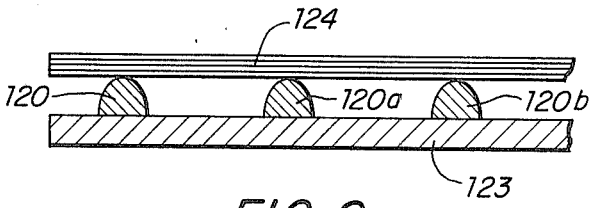
FIG. 8 is a sectional view along line 8—8 of FIG. 7.

In any of the embodiments in FIGS. 1–6 supports or bumpers 120, 122, on cylinder 123, FIG. 7, may be used to support the coil 124 against the force of gravity. Additional bumpers 126, 128 may also be used to limit motion of winding 124. Bumpers 120, 122, 126 and 128 may be disposed within compartments 100, 102, 104, FIG. 6, or between compartment bag segments 18, 20, 22, FIG. 1. A number of bumpers 120, 120*a*, 120*b* are spaced longitudinally along cylinder 123, FIG. 8.

When 2 or more coils are arranged concentrically as in FIG. 4 the magnetic interaction between the coils must be provided for. If the coils are exactly concentric a condition of unstable equilibrium prevails, and some form of feedback must be provided to maintain the concentric condition. This feedback might take the form of the position sensors 57, 59, 61 feedback comparator 52 and pumps 32, 34, 36 of the pressurizing circuit of FIG. 1.

Other embodiments will occur to those skilled in the art and are within the following claims:

What is claimed is:

1. A pressure support unit for limiting strain in a superconducting magnet coil induced by the magnetic field generated by the magnet coil comprising:

a restraining member surrounding said superconducting magnet coil for withstanding the force of the magnetic field generated by said superconducting magnet coil;

a pressure compartment disposed between said superconducting magnet coil and said restraining member and having at least one segment for receiving fluid pressurized proportional to the intensity of the field generated by said superconducting magnet coil for counterbalancing the force produced by the magnetic field and communicating a portion of the stress and resultant strain to said restraining member and reducing the strain in the said superconducting magnet coil.

2. The unit of claim 1 in which said winding and said restraining member are generally circular in cross-section.

3. The unit of claim 2 in which said winding and said restraining member are generally cylindrical.

4. The unit of claim 2 in which said winding and said restraining member are generally toroidal.

5. The unit of claim 1 in which said pressure compartment includes a plurality of circumferentially arranged segments.

6. The unit of claim 1 in which said pressure compartment includes a plurality of longitudinal segments arranged along the longitudinal axis of said winding.

7. A pressure support system for limiting strain in a number of superconducting magnet coils induced by the magnetic field generated by the magnet coils comprising a plurality of pressure support units, one associated with each of said superconducting magnet coils, each said unit including a restraining member surrounding said superconducting magnet coils for withstanding the force of the magnetic field generated by the said superconducting magnet coil;

a pressure compartment disposed betwen said superconductng magnet coil and said restraining member and having at least one segment for receiving fluid pressurized proportional to the intensity of the field generated by said superconducting magnet coil for counterbalancing the force produced by the magnetic field and communicating a portion of the stress and resultant strain to said restraining member and reducing the strain in said superconducting magnet coil.

8. The system of claim 7 in which each of said units surrounded by another said unit includes a second pressure compartment disposed between its restraining member and the winding of the other said surrounding unit.

9. The system of claim 7 in which said windings and said restraining members are generally circular in cross-section.

10. The system of claim 7 in which said windings and said restraining members are generally cylindrical.

11. The system of claim 7 in which said windings and said restraining members are generally toroidal.

12. The system of claim 7 in which each said pressure compartment includes a plurality of circumferentially arranged segments.

13. The unit of claim 7 in which each said pressure compartment includes a plurality of longitudinal segments arranged along the longitudinal axis of said windings.

* * * * *